US007611334B2

(12) United States Patent
Lee

(10) Patent No.: US 7,611,334 B2
(45) Date of Patent: Nov. 3, 2009

(54) PUMP WITH VARIANT STROKES

(76) Inventor: Wang-Ken Lee, 3531 Princeton Corners La., Marietta, GA (US) 30062

( * ) Notice: Subject to any disclaimer, the term of this patent is extended or adjusted under 35 U.S.C. 154(b) by 687 days.

(21) Appl. No.: 11/448,563

(22) Filed: Jun. 7, 2006

(65) Prior Publication Data

US 2007/0286741 A1 Dec. 13, 2007

(51) Int. Cl.
*F01B 29/04* (2006.01)
*F04B 49/00* (2006.01)

(52) U.S. Cl. ..... 417/218; 92/59

(58) Field of Classification Search ..... 417/345, 417/346, 486, 487, 488, 521, 531, 533, 534; 92/59

See application file for complete search history.

(56) References Cited

U.S. PATENT DOCUMENTS 1,880,494 A * 10/1932 Sandage ..... 417/454
4,400,144 A * 8/1983 Drutchas et al. ..... 417/415
5,076,769 A * 12/1991 Shao ..... 417/534
5,520,520 A * 5/1996 Nakamoto et al. ..... 417/63

* cited by examiner

*Primary Examiner*—Devon C Kramer
*Assistant Examiner*—Todd D Jacobs
(74) *Attorney, Agent, or Firm*—Joel D. Myers; Myers IP Law

(57) ABSTRACT

A pump with variant strokes has a body, a piston assembly and a decelerating member. The body and the decelerating member are respectively mounted adjacent to the piston assembly. A holder is mounted in the piston assembly and has multiple openings. When the decelerating member is driven to rotate and engages one of the openings in the holder, the piston assembly can move back and forth. Adjusting the decelerating member to connect to different one of the openings of the holder to form different rotating diameters can adjust the strokes of the present invention to provide different pressure and flow capacity.

6 Claims, 4 Drawing Sheets

PUMP WITH VARIANT STROKES

BACKGROUND OF THE INVENTION

1. Field of the Invention

The present invention relates to a pump with variant strokes, and more particularly to a pump that can select stroke of the pump to provide the better efficient output pressure and flow rate.

2. Description of the Related Art

In today's world, spraying chemicals such as disinfectant is very important. A conventional spraying method uses a pump to atomize liquids to a desired liquid particle mist.

In tool stores of agriculture, lawn & garden, carpet cleaning, pest control and roof or drive way sealing industries some conventional pumps have a piston seat, a driving member connected to the piston seat via a shaft. The driving member can be a motor to drive the piston seat to move up and down in a fixed stroke.

However none of these pumps, which we are aware, provide a pump having the several advantages and unique features of our invention especially in compact sizes, choice of various pump strokes and large pump output pressure to pump weight ratio.

The disadvantages of the conventional pump are described as follows:

1. The driving member drives the piston seat directly so the driving member must have a sufficient powerful twisting force. The driving member with a sufficient powerful twisting force has a large size and heavy weight.

2. Without the speed reduction mechanism, the piston seat moves quickly thereby that the local liquid pressure may drop below the vapor pressure to cause bubbles or cavitation in the conventional pump. Hence, the discharge pressure and flow are lowered and more particularly the conventional pump is damaged.

3. The stroke of the conventional pump is not changeable such that pressure or flow capacity of the conventional pump can not be adjusted as desired.

4. The driving member is connected to an end of the shaft only so that the shaft is suspended and endures stress with a high burden. The diameter of the shaft is increased to avoid deflection of the shaft. However, increasing the diameter of the shaft increases the size of the conventional pump.

Therefore, the invention provides a pump with variant strokes to mitigate or obviate the aforementioned problems.

SUMMARY OF THE INVENTION

The main objective of the present invention is to provide a pump with variant strokes to adjust pressure or flow capacity of the pump.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
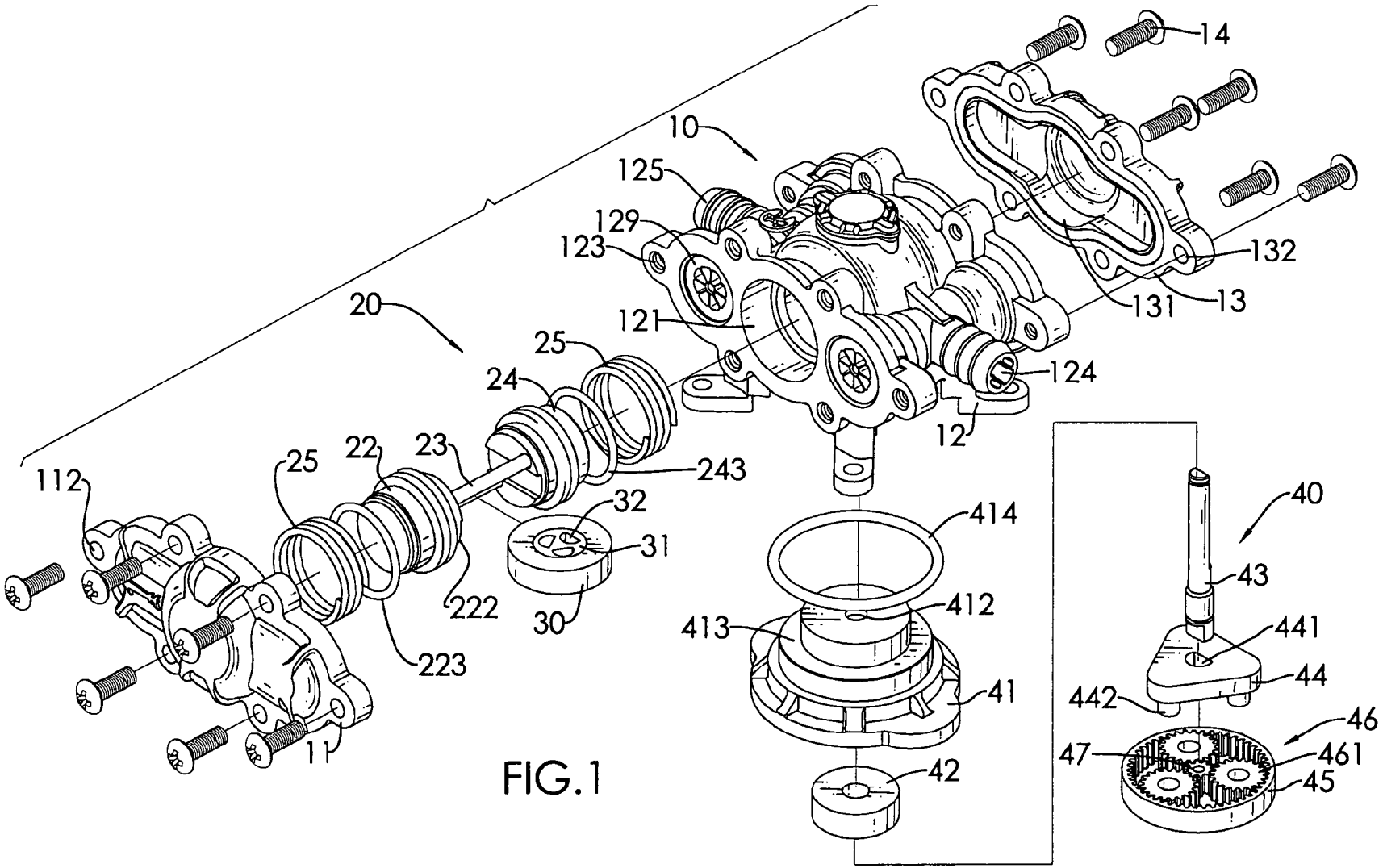
FIG. 1 is an exploded perspective view of a pump with variant strokes in accordance with the present invention.
Figure 2:
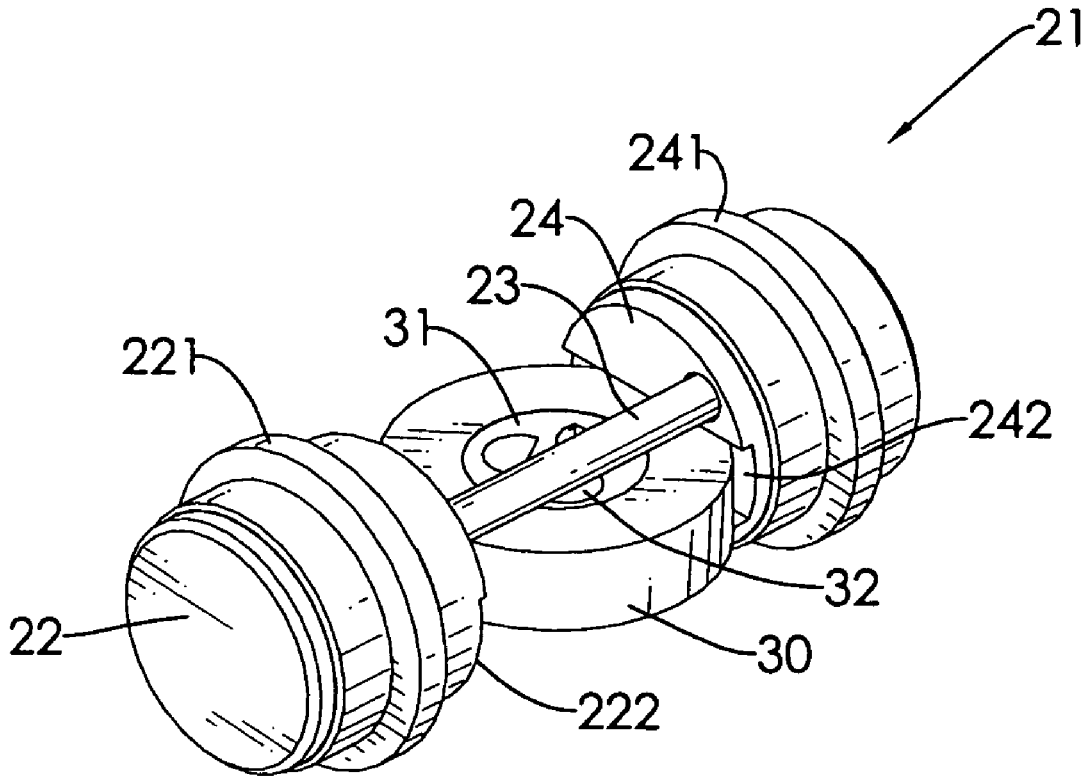
FIG. 2 is a perspective view of a piston of the pump with variant strokes in FIG. 1.

With reference to FIGS. 1-2, a pump with variant stroke in accordance with the present invention comprises a body (10), a piston assembly (20), a driving bearing (30) and a decelerating member (40).

The body (10) has a first shell (11), a second shell (12) and a third shell (13).

Figure 3:
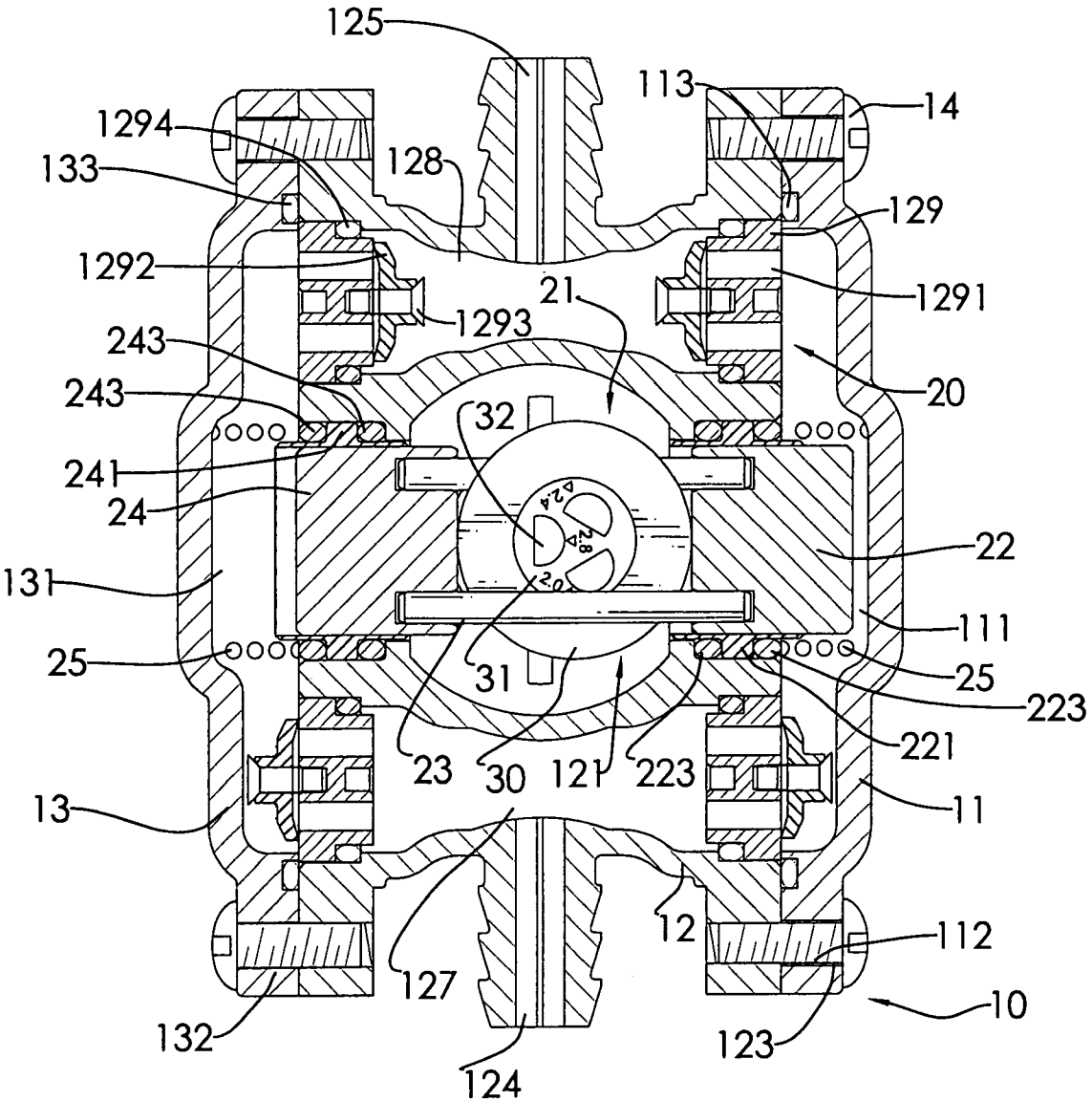
FIG. 3 is a top view in partial section of the pump with variant strokes in FIG. 1.

With further reference to FIG. 3, the first shell (11) has a chamber (111) defined in the first shell (11) and multiple first through holes (112) respectively defined through the first shell (11) near a periphery of the first shell (11).

The second shell (12) has a housing (121) defined in the second shell (12). The housing (121) has two step holes defined in two sides of the housing (121). An inlet cavity (127) and an outlet cavity (128) are defined respectively in the second shell (12) adjacent to the two sides of the housing (121). The inlet cavity (127) has two check valves and one of the check valves allows the liquid flowing into the chamber (111). The outlet cavity (128) has two check valves to allow the liquid flowing out of the outlet cavity (128). The check valves are mounted respectively at sidewalls of the inlet cavity (127) and the outlet cavity (128). Each check valve has a valve seat (129), a valve plate (1292), and a screw (1293). The valve seat (129) has multiple vents (1291) defined in the valve seat (129). A first O ring (1294) is mounted around the valve seat (129) and abuts against the outlet cavity (128) in the second shell (12). The valve plate (1292) is made of rubber to enhance the seal effect, can be arcuate form to generate resilience, is mounted on the valve seat (129) and corresponds to and seals the vents (1291). The screw (1293) extends through the valve plate (1292) and is fastened in the valve seat (129).

Figure 4:
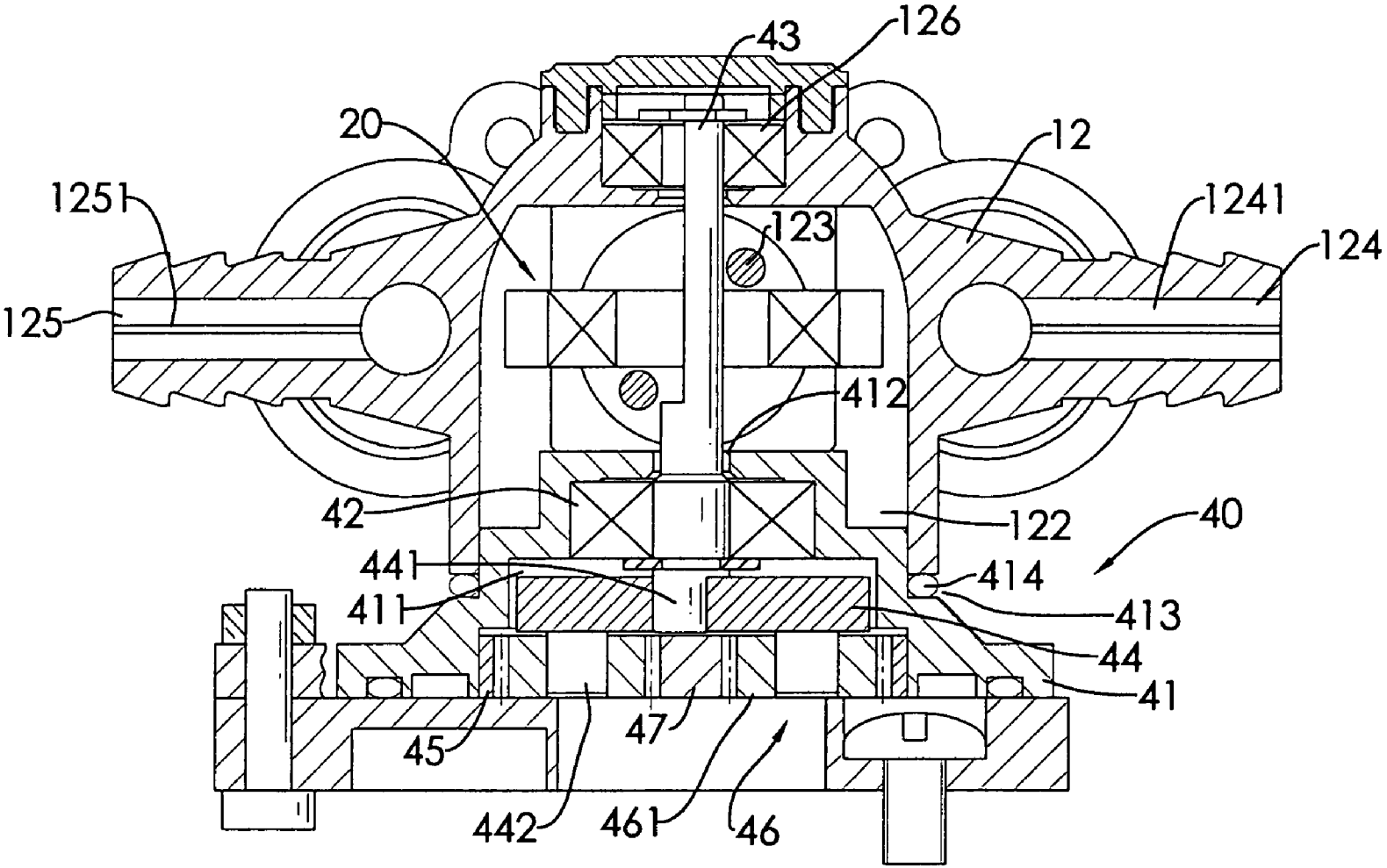
FIG. 4 is a side view in partial section of the pump with variant strokes in FIG. 1.

With further reference to FIG. 4, the second shell (12) has a communication hole (122) defined in an inner periphery of the second shell (12) and communicating with the housing (121) in the second shell (12). Multiple threaded holes (123) are defined separately through the second shell (12). An exit (125) and an entrance (124) are defined respectively in the inner periphery of the second shell (12). The entrance (124) communicates with the inlet cavity (127) and the exit (125) communicates with the outlet cavity (128). A bearing (126) is mounted in the second shell (12). Multiple first ribs (1241) are formed in an inner wall of the entrance (124) and multiple second ribs (1251) are formed in an inner wall of the exit (125).

The third shell (13) has a channel (131) defined in the third shell (13) and multiple second through holes (132) respectively defined through the third shell (13) near a periphery of the third shell (13). One of the check valves in the inlet cavity (127) allows the liquid flowing into the channel (131).

Multiple bolts (14) respectively extend through the first through holes (112) in the first shell (11) and the second through holes (132) in the third shell (13) and engage with the threaded holes (123) in the second shell (12) to fasten the first shell (11), the second shell (12) and the third shell (13). Hence, a fluid passage is formed between the chamber (111), the second shell (12) and the channel (131). A second O ring (113) is mounted in the first shell (11) and abuts against the second shell (12) to avoid fluid out of the first and second shell (11, 12). A third O ring (133) is mounted in the third shell (13) and abuts against the second shell (12) to avoid fluid out of the second and third shell (12, 13).

The piston assembly (20) is received in the housing (121) and has a piston seat (21) and two elastic elements (25).

With further reference to FIG. 2, the piston seat (21) has a first piston (22), a second piston (24) and two bars (23). The first piston (22) is mounted in the second shell (12) and extends into the chamber (111) of the first shell (11). A first pressure ring (221) with a lug is mounted around the first piston (22). A first notch (222) defined radially in an inside surface of the first piston (22).

Two first loops (223) are mounted respectively in the step holes of the housing (121) of the second shell (12) and are adjacent to the first pressure ring (221) to provide a sealing effect.

The second piston (24) is mounted in the second shell (12) and extends into the channel (131) of the third shell (13) and has a second pressure ring (241) with a lug. The second pressure ring (241) is mounted around the second piston (24). A second notch (242) is defined radially in an inside surface of the second piston (24). Two second loops (243) are mounted respectively in the step holes of the housing (121) of the second shell (12) and are adjacent to the second pressure ring (241) to provide a sealing effect.

The bars (23) are mounted between and connect to the first and second pistons (22, 24).

The elastic elements (25) are mounted between the first loop (223) and the chamber (111) in the first shell (11) and between the second loop (243) and the channel (131) in the third shell (13).

The driving bearing (30) has a central hole and engages between the first notch (222) of the first piston (22) and the second notch (242) of the second piston (24). A holder (31) is mounted in the central hole of the driving bearing (30). Three D-shaped openings (32) are defined separately in the holder (31). The distances between each opening (32) and the center of the holder (31) are different. The outer diameter of the driving bearing (30) is the same as the distance between the first notch (222) of the first piston (22) and the second notch (242) of the second piston (24).

The decelerating member (40) has a box (41), an inner bearing (42), a shaft (43), a bracket (44), a circular gear (45), a gear assembly (46) and a central gear (47).

The box (41) is mounted adjacent to the communication hole (122) and has a recess (411) defined in a bottom surface of the box (41). An axle hole (412) is formed in a top surface of the box (41). A flange (413) is defined in a periphery of the box (41). An annulus (414) is mounted around the flange (413) and abuts against the second shell (12).

The inner bearing (42) is mounted in the recess (411) in the box (41).

A first end of the shaft (43) is D-shaped in cross section, extends through a central hole in the inner bearing (42), the axle hole (412) in the box (41) and one of the openings (32) in sequence and extends into the bearing (126).

The bracket (44) is mounted in the recess (411) in the box (41) below the inner baring (42). A D-like orifice (441) is formed through the bracket (44) and is connected to a second end of the shaft (43). Multiple evenly-spaced posts (442) are formed separately on the bracket (44) and are opposite to the inner bearing (42).

The circular gear (45) is mounted in the recess (411) in the box (41) below the bracket (44).

The gear assembly (46) comprises multiple gears (461) and is mounted in the circular gear (45). Each gear (461) is mounted rotatably around a corresponding post (442) on the bracket (44).

The central gear (47) is mounted between the gears (46), engages the gears (46) and is driven by a motor.

Because the circular gear (45) is fastened in the box (41), the shaft (43) is slowed down by the circular gear (45). When the central gear (47) is rotating, the gear assembly (46) rotates at a slow speed and drives the holder (31) to rotate and the first and second pistons (22, 24) to move toward the first shell (11) or toward the third shell (13). The fluid flows into the inlet cavity (127) from the entrance (124). The fluid flows through the check valves (129) in the inlet cavity (127) to the chamber (111) of the first shell (11) and to the channel (131) of the third shell (13). With the check valves, the fluid cannot flow back to the inlet cavity (127) and can only pass along the sides of the first and second pistons (22, 24) of the piston assembly (20). Hence, the fluid is pressed by the moving pistons (22, 24) through the check valves in the outlet cavity (128), flows into the outlet cavity (128) and flows out of the second shell (12) through the exit (125) to transfer the liquid and amplify liquid pressure.

Changing the shaft (43) to connect to different one of the openings (32) of the driving bearing (30) to form different rotating diameters can adjust the strokes of the pump of the present invention as desired.

Additionally, with the first loop (223), the second loop (243), the first pressure ring (221) and the second pressure ring (241), the second shell (12) is sealed by the first and second pistons (22, 24) and the first and second pistons (22, 24) can move smoothly.

The advantages of the pump of the present invention are described as follows:

1. The piston seat (21) comprises the first piston (22), the bars (23) and the second piston (24). With respectively controlling the precision of the first piston (22), the bars (23) and the second piston (24), the piston seat (21) can be made precisely. Furthermore, the piston seat (21) can be made of materials that can resist abrasion or can resist chemical corrosion.
2. The piston seat (21) can move slowly via the decelerating member (40) so that the fluid in the second shell (12) can flow smoothly without generating bubble.
3. The motor only needs to drive the central gear (47) and then the central gear (47) drives the gear assembly (46) to drive the piston seat (21). Therefore, the pump of the present invention only needs a small power to drive the motor.
4. Changing the shaft (43) to connect to different one of the openings (32) of the driving bearing (30) to form different rotating diameters can adjust the strokes of the pump of the present invention as desired. Different stokes generate different pressures and different flows.
5. The shaft (43) are supported by the inner bearing (42) and the bearing (126) so that the shaft (43) is hard to be distorted, can bear large load and can reduce the diameter of the shaft (43).

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. A pump with variant strokes comprising:

a body having a housing defined in a center of the body;

an inlet cavity and an outlet cavity respectively defined in the body adjacent to two sides of the housing;

two check valves mounted respectively at sidewalls of the inlet cavity to allow liquid flowing out of the inlet cavity;

two check valves mounted respectively at sidewalls of the outlet cavity to allow liquid flowing into the outlet cavity;

an entrance defined in the body and communicating with the inlet cavity;

an exit defined in the body and communicating with the outlet cavity; and a communication hole defined in the body and communicating with the housing;

a piston assembly mounted in the housing and having a piston seat having a first piston mounted in and extending out of the housing and having a first notch defined radially in an inside surface of the first piston;

a second piston mounted in and extending out of the housing and having a second notch defined radially in an inside surface of the second piston; and two bars mounted between and connecting to the first piston and the second piston; and two elastic members mounted respectively between two ends of the piston seat and the body;

a driving bearing having a central hole and engaging the first notch of the first piston and the second notch of the second piston wherein a holder is mounted in the central hole of the driving bearing, at least two openings are defined separately in the holder and distances between each one of the at least two openings and a center of the holder are different;

a decelerating member mounted in the housing and connecting to one of the at least two openings of the holder.

2. The pump with variant stroke as claimed in claim 1, wherein a bearing is mounted in an inner wall of the housing in the body; and the decelerating member has a box, an inner bearing, a shaft, a bracket, a circular gear, a gear assembly and a central gear; the box is mounted adjacent to the communication hole and has a recess defined in a bottom surface of the box; an axle hole is formed in a top surface of the box; the inner bearing is mounted in the recess in the box; a first end of the shaft extends through a central hole in the inner bearing; the axle hole in the box and one of the at least two openings in sequence and extends into the bearing in the housing of the body; the bracket is mounted in the recess in the box below the inner baring; an orifice is formed through the bracket and is connected to a second end of the shaft; multiple evenly-spaced posts are formed separately on the bracket and are opposite to the inner bearing; the circular gear is mounted in the recess in the box below the bracket; the gear assembly comprises multiple gears and is mounted in the circular gear; each gear is mounted rotatably around a corresponding post on the bracket; and the central gear is mounted between the gears and engages the gears.

3. The pump with variant stroke as claimed in claim 1, wherein the body has a first shell, a second shell and a third shell; the first shell has multiple first through holes respectively defined through the first shell near a periphery of the first shell; the second shell has multiple threaded holes defined separately through the second shell; the entrance, the exit and the communication hole respectively defined in the second shell; the bearing is mounted in the second shell; multiple ribs are formed respectively in inner walls of the entrance and the exit; the third shell has multiple second through holes defined respectively through the third shell; multiple bolts respectively extend through the first and the second through holes in the first and third shells and engage with the threaded holes in the second shell; a flange is defined in a periphery of a box; a first loop is mounted in the second shell and is adjacent to the first piston; and an annulus is mounted around the flange and abuts against the second shell.

4. The pump with variant stroke as claimed in claim 2, wherein the body has a first shell, a second shell and a third shell; the first shell has multiple first through holes respectively defined through the first shell near a periphery of the first shell; the second shell has multiple threaded holes defined separately through the second shell; the entrance, the exit and the communication hole respectively defined in the second shell; the bearing is mounted in the second shell; multiple ribs are formed respectively in inner walls of the entrance and the exit; the third shell has multiple second through holes defined respectively through the third shell; multiple bolts respectively extend through the first and the second through holes in the first and third shells and engage with the threaded holes in the second shell; a flange is defined in a periphery of a box; a first loop is mounted in the second shell and is adjacent to the first piston; and an annulus is mounted around the flange and abuts against the second shell.

5. The pump with variant stroke as claimed in claim 1, wherein a first pressure ring is mounted around the first piston; two first loops are mounted respectively in the body and are adjacent to the first pressure ring on the first piston; a second pressure ring mounted around the second piston; two second loops are mounted respectively in the body and are adjacent to the second pressure ring on the second piston; and the elastic elements are mounted between the first loop and the body and between the second loop and the body.

6. The pump with variant stroke as claimed in claim 4, wherein a first pressure ring is mounted around the first piston; two first loops are mounted respectively in the second shell and are adjacent to the first pressure ring on the first piston; a second pressure ring mounted around the second piston; two second loops are mounted respectively in the second shell and are adjacent to the second pressure ring on the second piston; and the elastic elements are mounted between the first loop and the first shell and between the second loop and the third shell.

* * * * *